US012729483B2

(12) United States Patent
Lambert et al.

(10) Patent No.: US 12,729,483 B2
(45) Date of Patent: Sep. 8, 2026

(54) METHOD AND SYSTEM FOR TREATING BIOMASS

(71) Applicant: VALMET AB, Sundsvall (SE)

(72) Inventors: Francois Lambert, Sundsvall (SE); Rolf Boman, Sundsvall (SE)

(73) Assignee: VALMET AB, Sundsvall (SE)

( * ) Notice: Subject to any disclaimer, the term of this patent is extended or adjusted under 35 U.S.C. 154(b) by 995 days.

(21) Appl. No.: 17/784,297

(22) PCT Filed: Oct. 1, 2020

(86) PCT No.: PCT/SE2020/050924

§ 371 (c)(1),
(2) Date: Jun. 10, 2022

(87) PCT Pub. No.: WO2021/118425

PCT Pub. Date: Jun. 17, 2021

(65) Prior Publication Data

US 2023/0043719 A1 Feb. 9, 2023

(30) Foreign Application Priority Data

Dec. 13, 2019 (SE) ..... 1951452-0

(51) Int. Cl.
*D21C 1/04* (2006.01)
*D21C 1/10* (2006.01)
*D21C 9/18* (2006.01)

(52) U.S. Cl.
CPC ..... *D21C 1/04* (2013.01); *D21C 1/10* (2013.01); *D21C 9/18* (2013.01)

(58) Field of Classification Search
CPC ... D21C 1/04; D21C 1/10; D21C 9/18; D21C 1/02; Y02E 50/10; Y02E 50/30; C12P 2201/00
See application file for complete search history.

(56) References Cited

U.S. PATENT DOCUMENTS 4,427,453 A * 1/1984 Reitter ..... C13K 1/02 127/1
4,599,138 A * 7/1986 Lindahl ..... D21C 1/00 162/84

(Continued)

FOREIGN PATENT DOCUMENTS

EP 2 336 344 A1 6/2011
EP 3 333 313 A1 6/2018

(Continued)

OTHER PUBLICATIONS

Extended European Search Report issued in connection with EP Appl. No. 20898904.6 dated Nov. 17, 2023.

*Primary Examiner* — Stuart L Hendrickson
*Assistant Examiner* — Jaanzeb C Raja
(74) *Attorney, Agent, or Firm* — Foley & Lardner LLP

(57) ABSTRACT

Method for treating biomass, comprising compressing and dewatering (62) the biomass to a dry solid content of DS1% by weight; feeding (63) compressed biomass to a treatment vessel; adding (64) a treatment liquid to said treatment vessel; discharging (65) treated biomass; compressing and dewatering (66) discharged biomass to a dry solid content of DS2% by weight, and treating (68) the compressed and dewatered biomass in a hydrolysis reactor, wherein 1%<DS1−DS2<6%.

8 Claims, 4 Drawing Sheets

(56) References Cited

U.S. PATENT DOCUMENTS

| | | | | |
|---|---|---|---|---|
| 10,047,408 | B2 * | 8/2018 | Thyr | D21C 9/02 |
| 2013/0029406 | A1 | 1/2013 | Dottori et al. | |
| 2019/0271113 | A1 * | 9/2019 | Lambert | D21B 1/36 |

FOREIGN PATENT DOCUMENTS

| | | | | |
|---|---|---|---|---|
| EP | 3399095 | A1 * | 11/2018 | C12M 45/20 |
| WO | WO-2004/005608 | A1 | 1/2004 | |
| WO | WO-2015077885 | A1 * | 6/2015 | B30B 9/26 |
| WO | WO-2015/199604 | A1 | 12/2015 | |
| WO | WO-2019/059835 | A1 | 3/2019 | |

* cited by examiner

METHOD AND SYSTEM FOR TREATING BIOMASS

TECHNICAL FIELD

The invention relates to a method for treating biomass in a treatment vessel using a treatment liquid, and a corresponding system for treating biomass.

BACKGROUND

Methods for treating biomass in a treatment vessel using a treatment liquid, such as impregnation, soaking and mixing methods, are known in the art and may for example form a pre-treatment before an acid hydrolysis step. The present invention relates to such a method where biomass is compressed and dewatered prior to being fed to the treatment vessel, and where the treated biomass is also compressed and dewatered after being discharged from the treatment vessel to remove excess treatment liquid from the biomass. The biomass used in such biomass treatment methods may for instance be wood material, grasses, agricultural waste or residuals from the sugar or ethanol industry.

Although such methods are effective, there is still a need for a method with further improved runnability and/or reduced apparatus wear and/or improved quality of the end product.

SUMMARY

An object of the invention is to provide a method with one more improvements as discussed above.

These and other objects are achieved by the present invention by means of a method and a system according to the independent claims.

According to a first aspect of the invention, there is provided method for treating biomass comprising compressing and dewatering the biomass to a dry solid content of DS1% by weight, feeding compressed biomass to a treatment vessel, adding a treatment liquid to said treatment vessel, discharging treated biomass, and compressing and dewatering discharged biomass to a dry solid content of DS2% by weight, wherein DS2<DS1. The method may also comprise a step of supplying the biomass material, which biomass material may be wood material, grasses, agricultural waste or residuals from the sugar or ethanol industry.

In other words, the biomass is compressed and dewatered prior to being fed to the treatment vessel, and the biomass, after being treated with treatment liquid in the treatment vessel, is discharged and thereafter compressed and dewatered once again. The solid content (DS1) of the compressed and dewatered biomass prior to being fed to the treatment vessel, as measured in weight %, is higher than the solid content (DS2) of the compressed and dewatered biomass after treatment.

The above described difference in solid content may be achieved for instance by using the same type of device for compressing and dewatering before and after the treatment vessel, but operated/controlled in a different manner, or by using different types of apparatuses, where a first device for compressing and dewatering arranged before the treatment vessel is configured to provide greater compression and/or dewatering than a second device for compressing and dewatering arranged after the treatment vessel. The first device may comprise a first plug screw device. The second device may comprise a second plug screw device. In embodiments where both devices comprise plug screw devices, the first plug screw device may be configured and/or controlled to provide higher compression and/or dewatering than the second plug screw device. In other embodiments, at least one of the devices for compressing and dewatering may, in addition to, or instead of, the plug screw device comprises a force feed screw or screw press. For instance, a force feed screw may be used to pre-compress the biomass prior to being fed to a plug screw device. This is particularly advantageous when using bulky (low density) biomass.

It is understood that dry solid content, or the total solid content (TS), of the biomass is the mass of the solids remaining after a sample of biomass has been dried in air, preferably to a constant weight, divided by the original mass of the sample. Determining the total solid content is preferably performed according to ASTM E1756-08 according to which the samples are dried at 105 degrees centigrade for at least 12 hours. Other methods, such as ISO 18134 Solid biofuels, for determination of moisture in biofuels could also be used.

Dry solid content may be measured indirectly by measuring the amount of liquid coming out of the compressing and dewatering devices and by measuring dry solids of the material or calculated using available data.

It is furthermore understood that compressing and dewatering refers to removal of a liquid in general from the biomass (and not solely water).

The invention is based on the insight that improved treatment (impregnation for instance) may be achieved by means of dewatering the biomass to a high solid content before the treatment step. The invention is furthermore based on the insight that such improved treatment or impregnation allows milder conditions to be applied in the following process steps (hydrolysis for instance), which leads to reduced degradation products and deposits and consequently improved runnability of the process as a whole. The invention is furthermore based on the insight that treatment or impregnation of the biomass in most cases continues after the treatment step, i.e. in a buffer bin (if any) and/or in subsequent reactors, and in that transport of treatment liquid into inner portions the biomass material is caused by diffusion, which requires a certain concentration gradient to take place. The invention is furthermore based on the insight that dewatering should not be excessively high after the treatment step, since then too much treatment liquid is removed from outer portions of the biomass material, resulting in a flatter gradient, resulting in slow diffusion and consequently uneven treatment or impregnation, which in turn requires a tougher condition in the following process steps, and consequently more degradation products and deposits. High dewatering after treatment may also be correlated with high wear of the compression and dewatering device, since sand and abrasive material released during the preceding dewatering and treatment steps is removed in the compression and dewatering device after treatment to a greater extent. These insights together lead to the overall inventive insight that it is advantageous to dewater the biomass prior treatment to a higher solid content than after treatment.

In embodiments, the difference in solid content, DS1−DS2, is more than 0%, but less than 10%, preferably between 1% and 6%, and most preferably between 2% and 5%. The solid content of the biomass prior to the treatment step, DS1, may be between 35% and 60%, preferably between 40% and 60% and most preferably between 45% and 55%, as measured in weight %.

In embodiments, the method comprises conveying the biomass through the treatment vessel in a direction from the inlet towards the outlet, for instance in a lengthwise direction of the treatment vessel.

In embodiments, the treatment vessel is an impregnator. The treatment liquid may be a liquid being an aqueous solution, ethanol or mixtures thereof. The liquid may comprise chemicals selected from a group consisting of an acid, a catalyst or mixtures thereof. The acid may be a mineral acid, such as $H_2SO_4$, organic acid preferably acetic acid, nitric acid, phosphoric acid, or mixtures thereof. The acid may be in the form of a liquid containing acid as for example acetic acid, for example from a recirculated stream such as a filtrate, liquid or pressate obtained at different positions in the process.

In embodiments, the impregnator may be a substantially vertical impregnator being filled with treatment liquid up to a predetermined fill level, wherein the biomass is fed to the treatment vessel at a position below the predetermined fill level, wherein the method further comprises controlling the fill level by adding treatment liquid to the vessel, conveying the biomass vertically through the treatment vessel, and wherein the step of discharging comprises discharging treated biomass in an upper part, above said fill level, of the treatment vessel. In other embodiments, the impregnator may be a substantially horizontal impregnator, or have a longitudinal direction, i.e. the direction in which the biomass is conveyed, at an angle between the horizontal and vertical, while also being filled with treatment liquid up to a predetermined fill level in the same manner as the vertical impregnator.

In other embodiments, the treatment vessel is a soaking vessel, and the treatment liquid is a soaking liquid for soaking the biomass. In yet other embodiments, the treatment vessel is a mixing vessel, and the treatment liquid is a mixing liquid for mixing with the biomass. The soaking and mixing liquids may be liquids comprising chemicals selected from a group consisting of an acid, a catalyst or mixtures thereof.

In embodiments, the method comprises, after treating and compressing and dewatering, feeding biomass to a hydrolysis reactor.

According to a second aspect of the invention there is provided a system for treating biomass comprising a first compression device, a treatment vessel, at least one injection device and a second compression device. The first compression device has an inlet and an outlet, the compression device being configured to compress and dewater biomass received at said inlet. The treatment vessel comprises an inlet and an outlet. The at least one injection device is arranged to add a treatment liquid to said treatment vessel. The first compression device comprises, or is connected to, feeding means arranged to feed biomass from its outlet to the inlet of said treatment vessel. The second compression device is provided with an inlet and an outlet, wherein said second compression device comprises, or is connected to, feeding means arranged to feed biomass from the outlet of the treatment vessel to said second compression device, said second compression device being configured to compress and dewater biomass received at its inlet. The first compression device is configured to dewater the biomass received at its inlet to a higher solid content, as measured in weight %, compared to the second compression device. The at least one injection device may be arranged at or around the biomass inlet, at one or more positions at the bottom or sides of the treatment vessel. A screw conveyor may be arranged to discharge the biomass out of the treatment vessel. Alternatively, the treated biomass may be fall into a chute, a conveyor or the like arranged downstream of the treatment vessel. In embodiments, the treatment vessel comprises conveying means arranged to convey biomass through the treatment vessel.

In embodiments, the treatment vessel is a vertical impregnator comprising a vertical treatment vessel adapted to be filled with said treatment liquid up to a predetermined fill level, said vertical treatment vessel comprising an inlet at a lower/bottom/upstream portion thereof and an outlet at an upper/downstream portion thereof, said vertical treatment vessel being provided with level control means configured to continuously control the fill level by adding treatment liquid to the vessel. The vertical treatment vessel may comprise conveying means, for instance a screw conveyor, arranged to convey the biomass upwards through the treatment vessel. The vertical treatment vessel may have a height between about 1 meter and 20 meters and a diameter between 0.15 meters and 2.5 meters. The predetermined fill level may for example be 20-80% or 35-60% of the height of the vessel. The treatment vessel may be configured to dewater the biomass above the fill level prior to discharging from the treatment vessel. This may be achieved by means of the screw conveyor extending above the fill level up to the discharge of the treatment vessel.

In embodiments, the first compression device is connected to the treatment vessel via a retaining device in order to support the compression before the biomass is fed into the treatment vessel, and for sealing the treatment vessel from the compression unit. The retaining device may comprise a cone arranged in an expanding conduit, which cone is displaceable to adjust the flow resistance therethrough and is optionally also provided with a damper to compress the compressed biomass/plug from the compression device.

In embodiments, the first compression device comprises a first plug screw device and the second compression device comprises a second plug screw device. The first plug screw device may be provided with a different screw geometry and/or a different hole geometry than the second plug screw device, such that the first plug screw provides a higher compression ratio and dewatering than the second plug screw. The first and second plug screw devices may be provided with plug pipes, which the biomass passes through before discharging from the plug screw device, wherein the plug pipe of said first plug screw device is provided with dewatering holes to provide greater dewatering than the second plug screw device. The plug screws can have a volumetric compression ratio between 1.5 and 6.

The features of the embodiments described above are combinable in any practically realizable way to form embodiments having combinations of these features. Further, all features and advantages of embodiments described above with reference to the first aspect of the invention may be applied in corresponding embodiments of the second aspect of the invention and vice versa.

BRIEF DESCRIPTION OF THE DRAWINGS

Above discussed and other aspects of the present invention will now be described in more detail using the appended drawings, which show presently preferred embodiments of the invention, wherein.

DETAILED DESCRIPTION

Figure 1:
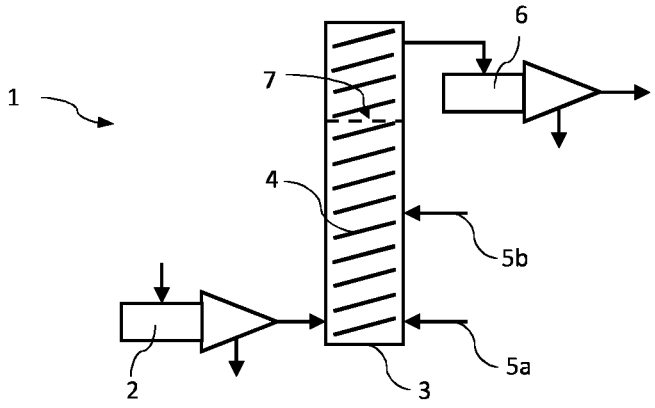
FIG. 1 shows an embodiment of a system according to the second aspect of the invention.

FIG. 1 shows an embodiment of a system according to the second aspect of the invention. The system 1 for treating biomass comprises first and second compression devices 2, 6 in the form of plug screw devices, a treatment vessel 3 being a vertical impregnator adapted to be filled with treatment liquid up to a predetermined fill level 7, the vertical impregnator having conveying means in the form of a vertical conveyor screw 4 arranged to convey the biomass vertically upwards in the vessel. The system further comprises injection devices 5*a*, 5*b* arranged to inject treatment liquid into the vessel at two positions below the fill level 7, as shown in the figure. In other embodiments, further injection devices may be provided, which may be distributed in the vertical and/or circumferential directions of the treatment vessel. The vertical impregnator is further provided with level control means comprising a level sensor, for instance a float sensor (not shown), and a control unit (not shown) configured to continuously control the fill level by injecting treatment liquid using the injection devices 5*a*, 5*b* when necessary to maintain the fill level 7. The first plug screw device 2 is configured to receive biomass through an inlet (shown as an arrow at an upper portion thereof), and to output compressed and dewatered biomass at an outlet coupled to an inlet of the treatment vessel at a lower portion thereof, as shown in FIG. 1. Liquid which has been dewatered from the biomass is outputted at the bottom of the plug screw device (shown as an outgoing arrow in the figure). Impregnated biomass which has been conveyed through the impregnator is discharged at an upper portion thereof, above the fill level 7, and is received at an inlet of the second plug screw device 6.

Figure 5A:
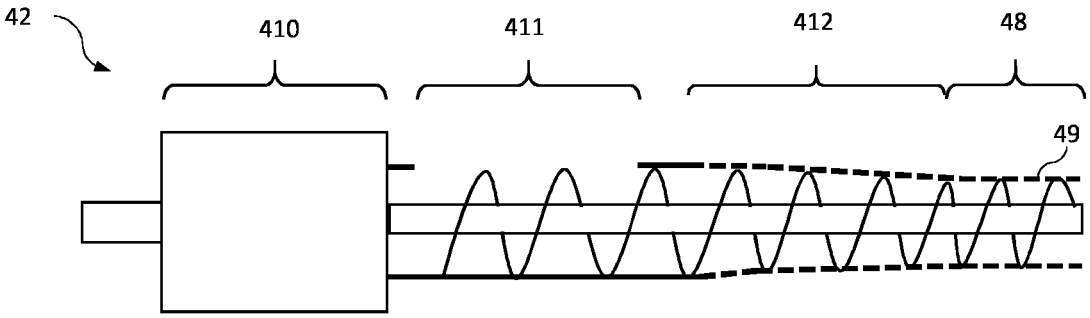
FIG. 5*a-b* show two examples of plug screw devices which may be part of the embodiments shown in FIGS. 1-4.
Figure 5B:
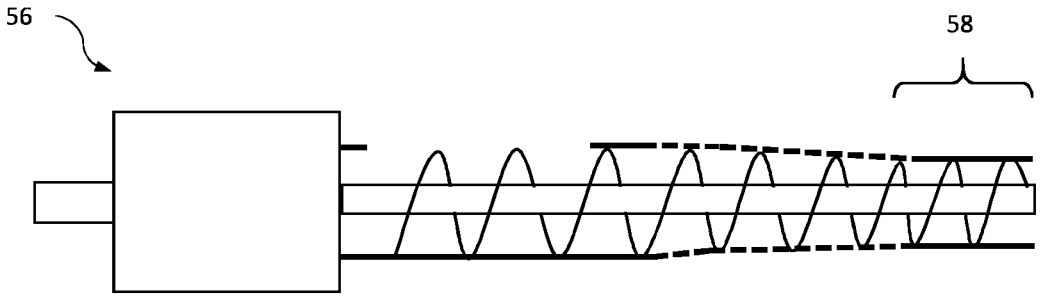

The first plug screw device 2 is configured to dewater the biomass received at its inlet to a higher solid content, as measured in weight %, compared to the second plug screw device 6. This is achieved by providing the first plug screw device with a plug pipe with dewatering holes, but not the second plug screw device, as shown in FIG. 5*a-b*. Alternatively, the different solid content may be achieved by providing the first plug screw device 2 with a different hole geometry and/or a different compression ratio than the second plug screw device. The treatment liquid is a liquid comprising chemicals selected from a group consisting of an acid, a catalyst or mixtures thereof. The treatment vessel 3 is optionally provided with counter threads (not shown) at the uppermost portion thereof to co-operate with the threads of the conveyor screw 4.

Figure 2:
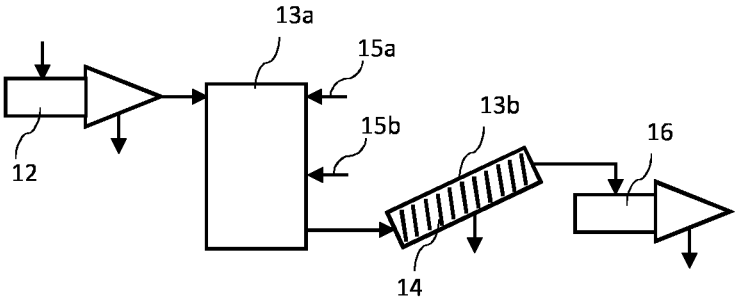
FIG. 2 shows another embodiment of a system according to the second aspect of the invention.

FIG. 2 shows another embodiment of a system according to the second aspect of the invention. The first and second plug screw devices 12, 16 correspond to plug screw devices 2, 6 in FIG. 1. This embodiment differs from FIG. 1 however in that the treatment vessel is of a different type, being a soaking bin 13*a* provided with injection devices 15*a*, 15*b* for injecting soaking liquid into the soaking bin 13*a* at two positions as seen in the figure. An outlet at a bottom portion of the soaking bin 13*a* is connected to an inclined drainage screw 13*b* being provided with a screw conveyor 14 configured to convey the biomass while draining excess soaking liquid from the biomass. The outlet of the drainage screw is connected to the second plug screw device 16. The soaking liquid is a liquid comprising chemicals selected from a group consisting of an acid, a catalyst or mixtures thereof.

Figure 3:
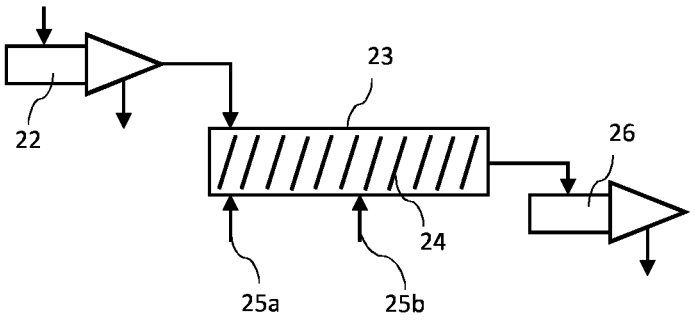
FIG. 3 shows yet another embodiment of a system according to the second aspect of the invention.

FIG. 3 shows another embodiment of a system according to the second aspect of the invention. The first and second plug screw devices 22, 26 correspond to plug screw devices 2, 6 in FIG. 1. This embodiment differs from FIG. 1 however in that the treatment vessel is of a different type, being a mixing screw device 23 provided with injection devices 25*a*, 25*b* for injecting mixing liquid into the mixing screw at two positions, the first one being below the inlet of the compressed/dewatered biomass from the first plug screw device 22 and the second one being an intermediate position as seen in the lengthwise direction of the treatment vessel. The mixing screw device is provided with a screw conveyor 24 arranged to convey the biomass forwards, in the right direction as seen in the figure, to an outlet, to which the second plug screw 26 device is connected to received treated/mixed biomass. The treatment liquid is a liquid comprising chemicals selected from a group consisting of an acid, a catalyst or mixtures thereof.

Figure 4:
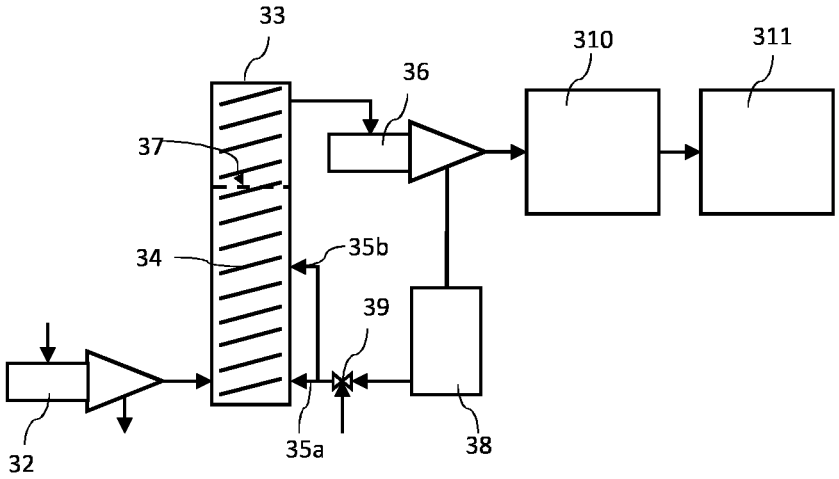
FIG. 4 shows yet another embodiment of a system according to the second aspect of the invention.

FIG. 4 shows yet another embodiment of a system according to the second aspect of the invention. The first and second plug screw devices 32, 36 correspond to plug screw devices 2, 6 in FIG. 1, and the vertical impregnator 33 with conveyor screw 34, injection devices 35*a*, 35*b* and fill level 37 correspond to impregnator 3, screw 4, injection devices 5*a*, 5*b* and fill level 7 in FIG. 1. This embodiment is however provided with further devices. A buffer bin 310 is provided after the second plug screw 36. As explained in the summary above, impregnation may continue in the buffer bin, the addition of which thus may lead to improved impregnation. Furthermore, a hydrolysis reactor 311 is shown in the figure, to which the biomass is conveyed from the buffer bin 310. The treatment liquid injected by injection devices 35*a*, 35*b* is received via control valve 39 to which a source of fresh impregnation liquid is connected as well as a tank 38 of recycled impregnation liquid being discharged pressate from the second plug screw device 36, as indicated by the arrows in FIG. 4. The fresh impregnation liquid may also be contained in a tank (not shown in the figure). In other embodiments, the system may furthermore be provided with an additional dewatering step before the first and/or second plug screw devices 32, 36, for instance a drainage screw as shown in FIG. 2. The treatment vessel 33 is optionally provided with counter threads (not shown) at the uppermost portion thereof to co-operate with the threads of the conveyor screw 34.

FIG. 5*a-b* show two examples of plug screw devices which may be part of the embodiments shown in FIGS. 1-4. FIG. 5*a* shows a plug screw device 42 comprising a bearing house 410 in which the screw axle (extending to the left of the bearing house, and connectable to a motor) is rotatably arranged. An inlet 411 and a conical throat 412 are provided, followed by a plug pipe 49 of constant diameter in which a plug of compressed biomass material is formed. In FIG. 5*a*, the plug pipe 48 is formed with dewatering holes 49, i.e. perforated walls, to provide further dewatering after the conical portion 412. FIG. 5*b* shows a plug screw device 56 which is identical to that in FIG. 5*a*, except that the plug pipe 58 is not provided with dewatering holes. The plug screw 42 in FIG. 5*a* is thus suitable as the first plug screw device in FIG. 1-4, whereas the plug screw 56 in FIG. 5*b* is suitable as the second plug screw device.

Figure 6:
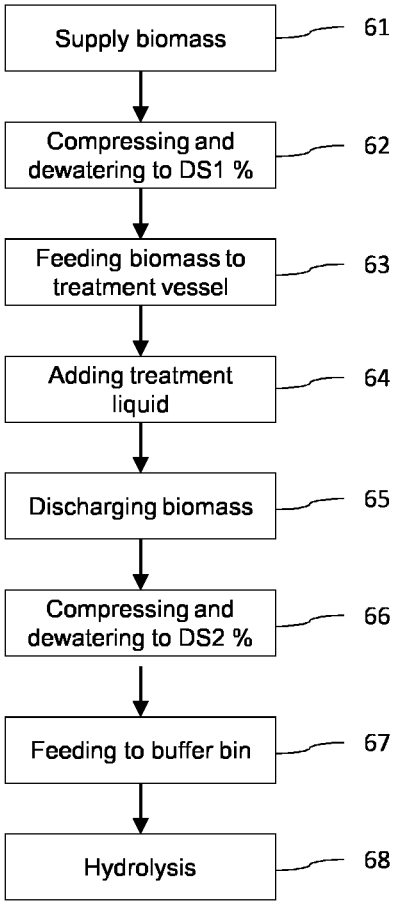
FIG. 6 shows a flow chart illustrating an embodiment of a method according to the first aspect of the invention.

FIG. 6 shows a flow chart illustrating an embodiment of a method according to the first aspect of the invention. The method for treating biomass comprises supplying 61 biomass material, compressing and dewatering 62 the biomass to a dry solid content of DS1% by weight, feeding 63 compressed biomass to a treatment vessel, adding 64 a treatment liquid to said treatment vessel, discharging 65 treated biomass, compressing and dewatering 66 discharged biomass to a dry solid content of DS2% by weight, wherein DS2<DS1, feeding (67) the biomass to a buffer bin for further impregnation while stored therein, and feeding the biomass to a hydrolysis reactor for acid hydrolysis (68) of the biomass.

The description above and the appended drawings are to be considered as non-limiting examples of the invention. The person skilled in the art realizes that several changes and modifications may be made within the scope of the invention. For example, the first and/or second plug screw device may be replaced with other types of compressing and dewatering devices, for instance screw presses, twin-roll presses or any other type of devices suitable for the described purpose. Furthermore, one or more conveying devices may be arranged between the described devices, for instance between a plug screw device and the treatment vessel. Furthermore, there may be fewer or further injection devices for injection of treatment liquid.

The invention claimed is:

1. A method for treating biomass, comprising:

compressing and dewatering the biomass to a dry solid content of DS1% by weight, which is performed at least in part using a first plug screw device;

feeding compressed biomass to an impregnator;

adding a treatment liquid to said impregnator;

discharging treated biomass from said impregnator;

compressing and dewatering discharged biomass to a dry solid content of DS2% by weight, which is performed at least in part using a second plug screw device, and performing hydrolysis on the compressed and dewatered biomass in a hydrolysis reactor, wherein said first plug screw device is configured and/or controlled to provide higher compression and/or dewatering than the second plug screw device such that 1%<DS1−DS2<6%.

2. The method according to claim 1, wherein 2%<DS1−DS2<5%.

3. The method according to claim 2, wherein 35%<DS1<60%.

4. The method according to claim 1, wherein said treatment liquid is a liquid comprising chemicals selected from a group consisting of an acid, a catalyst or a mixture thereof.

5. The method according to claim 4, wherein said impregnator is a substantially vertical impregnator being filled with said treatment liquid up to a predetermined fill level, said biomass being fed to the treatment vessel at a position below the predetermined fill level, said method further comprising:

controlling the fill level by adding treatment liquid to the vessel, and conveying the biomass through the treatment vessel, wherein said discharging comprises discharging treated biomass in an upper part, above said fill level, of the treatment vessel.

6. The method according to claim 1, further comprising, after said compressing and dewatering discharged biomass, feeding the biomass to a buffer bin.

7. The method according to claim 1, wherein each of the first plug screw device and the second plug screw device includes dewatering holes, and a quantity of dewatering holes in the second plug screw device is less than a quantity of dewatering holes in the first plug screw device.

8. The method according to claim 7, wherein the first plug screw device comprises a first plug pipe that includes the dewatering holes, and the second plug screw device comprises a second plug pipe without the dewatering holes.

* * * * *